US006874343B1

(12) United States Patent
Ariji

(10) Patent No.: US 6,874,343 B1
(45) Date of Patent: Apr. 5, 2005

(54) PRESS BRAKE AND METHOD OF CONTROLLING BIDIRECTIONAL FLUID PUMP OF HYDRAULIC CYLINDER OF PRESS BRAKE

(75) Inventor: Nobuaki Ariji, Kanagawa (JP)

(73) Assignee: AMADA Company, Limited, Kanagawa (JP)

( * ) Notice: Subject to any disclaimer, the term of this patent is extended or adjusted under 35 U.S.C. 154(b) by 336 days.

(21) Appl. No.: 10/111,386

(22) PCT Filed: Nov. 2, 2000

(86) PCT No.: PCT/JP00/07732

§ 371 (c)(1),
(2), (4) Date: May 2, 2002

(87) PCT Pub. No.: WO01/34317

PCT Pub. Date: May 17, 2001

(30) Foreign Application Priority Data

Nov. 5, 1999 (JP) ..... 11-315983
Nov. 8, 1999 (JP) ..... 11-317422

(51) Int. Cl.[7] ..... B21D 9/08
(52) U.S. Cl. ..... 72/20.1; 72/51.5; 72/443; 72/453.01
(58) Field of Search ..... 72/443, 20.1, 21.5, 72/453.01

(56) References Cited

U.S. PATENT DOCUMENTS 3,827,328 A * 8/1974 LaFlamme et al. ..... 72/443
4,208,935 A * 6/1980 Kollmar ..... 72/443
4,797,831 A 1/1989 Dressing et al.
5,027,631 A * 7/1991 Naito ..... 72/443
5,031,431 A * 7/1991 Naito ..... 72/443
5,069,060 A * 12/1991 Ishii ..... 72/443
5,669,257 A * 9/1997 Inoue et al. ..... 72/443
5,931,379 A 8/1999 Kim

FOREIGN PATENT DOCUMENTS

| | | |
|---|---|---|
| EP | 0540476 | 5/1993 |
| JP | 5-296203 | 11/1993 |
| JP | 8-164500 | 6/1996 |
| JP | 8-168897 | 7/1996 |
| JP | 9-262622 | 10/1997 |
| JP | 10281477 | 10/1998 |

OTHER PUBLICATIONS

English Language Abstract of JP 8–168897.
English Language Abstract of JP 10–281477.
English Language Abstract of JP 9–262622.
English Language Abstract of JP 5–296203.
English Language Abstract of JP 08–164500.

* cited by examiner

*Primary Examiner*—David Jones
(74) *Attorney, Agent, or Firm*—Greenblum & Bernstein, P.L.C.

(57) ABSTRACT

A controller for a press brake controls a servomotor to reverse the rotation of a bidirectional piston pump so as to reverse the vertical movement of a hydraulic cylinder and a ram. A command generator maintains a constant speed for a predetermined warmup time or distance after the ram movement is reversed, and afterwards changes the ram speed to a predetermined speed. A ram position, set according to a moving speed pattern, is compared to the actual position of the ram to conform the ram to the moving speed pattern. The moving speed may be limited based on at least one of a pressure and a detected by a pressure sensor.

6 Claims, 7 Drawing Sheets

PRESS BRAKE AND METHOD OF CONTROLLING BIDIRECTIONAL FLUID PUMP OF HYDRAULIC CYLINDER OF PRESS BRAKE

TECHNICAL FIELD

The present invention relates to a press brake which executes a bending process by vertically moving a ram using a hydraulic cylinder and, in particular, to controlling a bidirectional fluid pump that operates the hydraulic cylinder.

BACKGROUND ART

A press brake executes a bending process on the basis of cooperation between a punch and a die. A ram is vertically moved using a hydraulic cylinder which is operated by a bidirectional fluid pump. A hydraulic circuit provided in the hydraulic cylinder is shown and described with respect to FIG. 1.

In the hydraulic circuit mentioned above, pipings 101 and 103, connected to an upper cylinder chamber or a lower cylinder chamber of, a hydraulic cylinder (not shown), are connected to a bidirectional fluid pump 107 that is rotated by a servo motor 105. Further, the pipings 101 and 103 are respectively connected to an oil tank 113 via check valves 109 and 111.

Accordingly, the bidirectional fluid pump 107 is rotated by the servo motor 105, a working fluid is supplied to the upper or lower cylinder chamber (not shown) through the piping 101 or the piping 103, and a ram (not shown) is thereby vertically moved. The working fluid is supplied from the oil tank 113 via the check valve 109 or the check valve 111.

For the hydraulic circuit mentioned above, a command is given to the servo motor 105 to rotate the bidirectional fluid pump 107 so that the ram is vertically moved according to a pattern shown in FIG. 2. That is, the ram increases speed according to a fixed acceleration rate, moves at a fixed speed after reaching a predetermined speed, and reduces speed according to a fixed deceleration rate.

However, in the prior art mentioned above, a negative pressure may be applied to a check valve 109 or 111 when the check valve 109 or 111 is still open and the bidirectional fluid pump 107 is reverse rotated to change the moving direction of the ram. When the bidirectional fluid pump 107 is reverse rotated and a positive pressure is suddenly applied, the working fluid may flow back until the open check valve 109 or 111 is closed. When the working fluid flows back, a response is deteriorated, and the movement of the ram is unstable as shown in FIG. 3. Furthermore, a large shock occurs at a time of reverse rotation. Moreover, it is impossible to increase a motion gain of the ram. Accordingly, productivity is reduced.

The present invention takes the problems in the prior art into consideration.

Accordingly, an object of the present invention is to provide a press brake and a method of controlling a bidirectional fluid pump of the press brake. According to an aspect of the present invention, a motion gain of a ram can increase so as to improve productivity by reducing a shock at a time of reverse rotation.

Another object of the present invention is to provide a press brake which can reduce a noise generated by a bidirectional fluid pump that operates a hydraulic cylinder.

DISCLOSURE OF THE INVENTION

In order to achieve the objects mentioned above, according to a first aspect of the invention, a press brake is provided. The press brake includes a ram capable of moving vertically and a hydraulic cylinder that moves the ram vertically. The press brake also includes a bidirectional fluid pump that operates the hydraulic cylinder in a vertical direction. The bidirectional fluid pump is connected to the hydraulic cylinder and rotates forward and backward so as to move the ram upward and downward.

The press brake also includes a servo motor that rotates the bidirectional fluid pump. A control apparatus controls the servo motor. The control apparatus includes a ram moving speed pattern command portion that presets a ram moving speed pattern which maintains a ram speed for a warmup time or distance after reversing a rotation of the bidirectional fluid pump. Thereafter, the ram speed is changed to a predetermined speed.

A command position counter reads a ram position on the basis of the ram speed preset by the ram moving speed pattern command portion. A ram position detector detects the actual position of the ram. An adder adds (compares) the ram position read by the command position counter and the ram position signal from the ram position detector so as to give an instruction to position the ram at a desired position.

In the structure mentioned above, in order to switch the vertical movement of the hydraulic cylinder and the ram, the control apparatus controls the servo motor to reverse the rotation of the bidirectional fluid pump. At this time, the ram moving speed pattern command portion of the control apparatus executes the pattern command of the preset ram moving speed pattern. The moving speed of the ram is fixed for the predetermined warmup time or distance and thereafter the moving speed of the ram is changed to the predetermined speed. The command position counter reads the ram position from the ram moving speed pattern, and the adder adds (compares) the ram moving speed pattern position and an actual ram position detected by the ram position detector, whereby the rotation of the servo motor is controlled so that the ram is positioned at a desired position.

Accordingly, it is possible to reduce a shock at a time of rising and it is possible to prevent the ram from vibrating at a time of moving. Therefore, it is possible to increase a motion gain of the ram so as to improve productivity.

According to a second aspect of the invention, there is provided a method of controlling a bidirectional fluid pump of a hydraulic cylinder of a press brake. The method includes reversing a bidirectional fluid pump so as to reverse a vertical movement of the ram. After reversing the bidirectional fluid pump, the method includes setting a predetermined warmup time or a warmup distance for temporarily maintaining a moving speed of the ram. After setting the warmup time or distance, the method includes controlling the bidirectional fluid pump so as to change the ram speed to a predetermined speed. A bending process is executed in accordance with the hydraulic cylinder being moved vertically in correspondence to the rotational direction of the bidirectional fluid pump. Accordingly, the ram is moved upward and downward.

In the structure mentioned above, in the case of reversing the rotation of the bidirectional fluid pump in order to switch the vertical movement of the hydraulic cylinder and the ram, the moving speed of the ram is fixed for the predetermined warmup time or warmup distance, and thereafter the moving speed of the ram is changed to the predetermined speed after the reverse rotation.

Accordingly, it is possible to reduce a shock at a time of rising and it is possible to prevent the ram from vibrating at a time of moving. Therefore, it is possible to increase a motion gain of the ram so as to improve productivity.

According to a third aspect of the invention, there is provided a method of controlling a bidirectional fluid pump of a hydraulic cylinder of a press brake. The method includes measuring a hydraulic force in a bidirectional fluid pump and computing a change amount of the hydraulic force. The method also includes calculating a ram moving speed with respect to a pressure detected at a certain time or a ram moving speed with respect to a change amount of the pressure at this time. The ram moving speed is calculated on the basis of a predetermined relationship between the pressure and the ram moving speed or a predetermined relationship between the pressure change amount and the ram moving speed. The calculations result in minimizing a noise at a time that the bidirectional fluid pump rotates. The method also includes determining a rotational amount corresponding to the calculated speed. The servo motor is instructed to rotate the bidirectional fluid pump, using the determined rotational amount. The bidirectional fluid pump is operated so as to rotate the servo motor, and the ram is moved upward and downward by the hydraulic cylinder, thereby executing a bending process.

According to a fourth aspect of the invention, there is provided a method of controlling a bidirectional fluid pump of a hydraulic cylinder of a press brake. The method includes measuring a hydraulic force in a bidirectional fluid pump and computing a change amount of the hydraulic force. The method also includes calculating a ram moving speed with respect to a pressure detected at a certain time and a ram moving speed with respect to a change amount of the pressure at this time. The ram moving speeds are calculated on the basis of a predetermined relationship between pressure and ram moving speed or a predetermined relationship between a pressure change amount and ram moving speed. The calculations result in minimizing a noise at a time that the bidirectional fluid pump rotates. The method also includes comparing the calculated speeds to obtain the lowest ram moving speed. The method also includes determining a rotational amount corresponding to the lowest calculated ram moving speed. The servo motor is instructed to rotate the bidirectional fluid pump, using the determined rotational amount. The method also includes operating the bidirectional fluid pump so as to rotate the servo motor, and moving the ram upward and downward by the hydraulic cylinder, thereby executing a bending process.

According to the structure mentioned above, the control is executed by detecting the hydraulic force of the bidirectional fluid pump rotated by the servo motor and calculating the change amount of the hydraulic force. The lower ram moving speed is selected on the basis of the predetermined relationship between pressure and the ram moving speed and the predetermined relationship between pressure change amount and the ram moving speed. The calculations result in minimizing noise at a time when the bidirectional fluid pump rotates. The servo motor is provided with the rotational amount corresponding to the selected ram moving speed.

Accordingly, it is possible to restrict the noise of the bidirectional fluid pump.

According to a fifth aspect of the invention, a press brake is provided. The press brake includes a vertically movable ram and a hydraulic cylinder that moves the ram vertically. The press brake also includes a bidirectional fluid pump that operates the hydraulic cylinder in a vertical direction. The bidirectional fluid pump is connected to the hydraulic cylinder and rotates forward and backward so as to move the ram upward and downward. The press brake also includes a servo motor that rotates the bidirectional fluid pump.

A ram position detector detects a position of the ram in a vertical direction. The press brake also includes a ram moving speed pattern command portion that provides a moving pattern of the ram. A computing portion computes a pressure, as sensed by a pressure sensor, or a pressure change amount. A ram moving speed computing portion computes a ram moving speed, based on the pressure or pressure change amount. A servo motor rotation command portion provides a rotational amount, corresponding to the ram moving speed, to the servo motor.

According to a sixth aspect of the invention, a press brake is provided. The press brake includes a vertically movable ram and a hydraulic cylinder that moves the ram upward and downward. The press brake also includes a bidirectional fluid pump that operates the hydraulic cylinder in a vertical direction. The bidirectional fluid pump is connected to the hydraulic cylinder and rotates forward and backward so as to move the ram upward and downward. The press brake also includes a servo motor that rotates the bidirectional fluid pump.

A ram position detector detects a position of the ram in a vertical direction. A ram moving speed pattern command portion provides a moving pattern of the ram. An adder applies a rotation command to the servo motor rotating the bidirectional fluid pump. The adder compares a ram position from the ram moving speed pattern command portion with an actual ram position from the ram position detector so as to correct the ram position.

A pressure sensor detects a pressure of the bidirectional fluid pump. A computing portion computes a pressure change amount on the basis of a pressure signal that indicates the pressure detected by the pressure sensor. A memory stores a relation between the ram moving speed and the pressure of the bidirectional fluid pump and a relation between the ram moving speed and the pressure change amount. A servomotor rotational amount command portion compares the relation between the ram moving speed and the pressure of the bidirectional fluid pump with the relation between the ram moving speed and the pressure change amount so as to select one having the smaller ram moving speed. The servo motor rotational amount command portion provides the rotational amount corresponding to the ram moving speed to the servo motor.

According to the structure mentioned above, the bending process having a high accuracy is executed by controlling the servo motor according to the command pattern from the ram moving speed pattern command portion. Accordingly, the hydraulic cylinder is moved upward and downward by the bidirectional fluid pump. The process includes detecting the actual ram position by the ram position detector and comparing the instructed position with the actual ram position so as to control the servo motor. The hydraulic force of the bidirectional fluid pump is detected by the pressure sensor provided in the bidirectional fluid pump, and the computing portion calculates the change amount of the hydraulic force on the basis of the pressure. The ram speed determining portion determines the lower ram moving speed and selects the ram moving speed in order to reduce the noise. The ram moving speed is selected based on the predetermined pressure-ram moving speed relation and the pressure change amount-ram moving speed relation which are stored in the memory. The servo motor rotational amount command portion provides the rotational amount corresponding to the selected ram moving speed to the servo motor.

Accordingly, it is possible to restrict the noise of the bidirectional fluid pump.

BEST MODE FOR CARRYING OUT THE INVENTION

An embodiment of the present invention will be explained below in detail with reference to the accompanying drawings.

Figure 4:
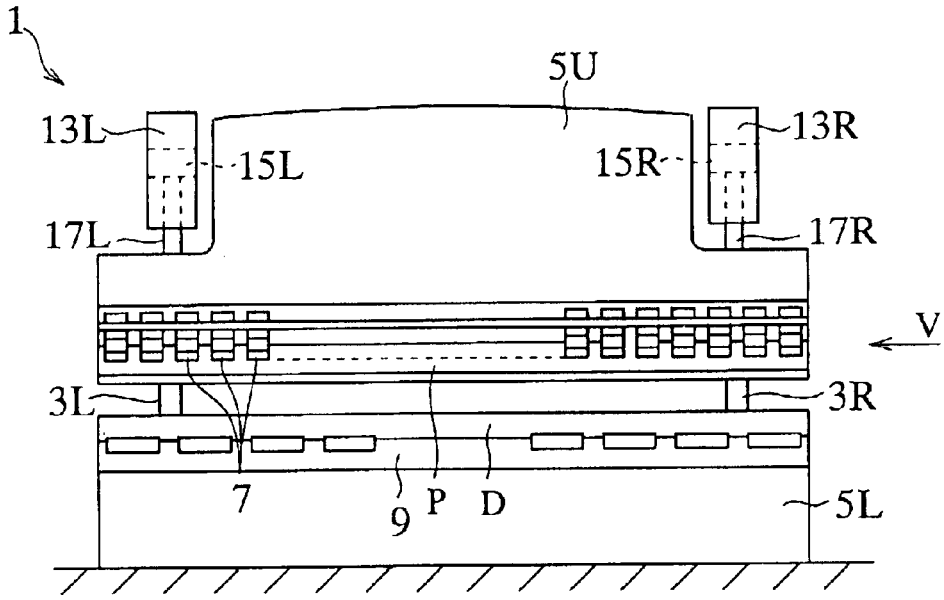
FIG. 4 is a front elevational view showing a whole of a press brake according to the present invention.
Figure 5:
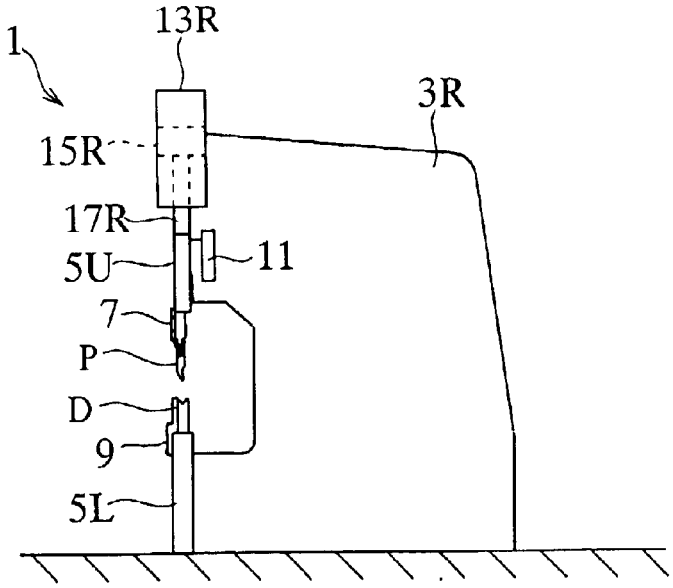
FIG. 5 is a side elevational view as seen from a direction V in FIG. 4.

In FIGS. 4 and 5, there is shown a whole of a press brake 1 according to the present invention. This press brake 1 has side plates 3L and 3R provided in left and right sides. The press brake 1 also has an upper table 5U serving as a ram on front end surfaces of upper portions in the side plates 3L and 3R, so as to freely move upward and downward. The press brake 1 is also provided with a lower table 5L on front surfaces of lower portions in the side plates 3L and 3R.

A punch P is provided in a lower end portion of the upper table 5U via a plurality of intermediate plates 7, so as to be freely replaced. Further, a die D is provided in a die holder 9 provided in an upper end portion of the lower table 5L, so as to be freely replaced.

Incidentally, an exemplary linear scale 11 operating as a ram position detecting means is provided for measuring a position of height of the upper table 5U. Whether or not the bending process is finished, a bending angle detection and the like are executed by determining an interval with respect to the die D on the basis of the height of the punch P.

Hydraulic cylinders 13L and 13R are respectively provided in the front surfaces of the upper portions in the left and right side plates 3L and 3R. The upper table 5U is mounted to piston rods 17L and 17R which are attached to pistons 15L and 15R of the hydraulic cylinders 13L and 13R.

Next, a hydraulic circuit for the hydraulic cylinders 13L and l3R and a control apparatus 18 will be explained with reference to FIG. 6. Incidentally, since the left and right hydraulic cylinders 13L and 13R are provided with the same hydraulic circuit, the hydraulic cylinder 13R and the hydraulic circuit which are provided in the right side will be explained as follows.

An upper cylinder chamber 19U of the hydraulic cylinder 13R, for moving the upper table 5U that corresponds to the ram upward and downward, is connected to a prefill valve 23 by a piping 21, and is further connected to an oil tank 27 by a piping 25.

Further, the upper cylinder chamber 19U is connected by a piping 29 to one side of a bidirectional piston pump 31 that corresponds to a bidirectional fluid pump capable of rotating in two directions. A piping 33 is connected to a middle of the piping 29, and is connected to the oil tank 27 via a check valve 35 and a suction filter 37. Incidentally, the bidirectional piston pump 31 is rotated by an AC servo motor 39 corresponding to a servo motor controlled by the control apparatus 18.

A piping 41 is connected to a lower cylinder chamber 19L of the hydraulic cylinder 13R, and a counter balance valve 43 and a sequence switch valve 45, corresponding to an electromagnetic poppet valve, are provided in parallel. The counter balance valve 43 and the sequence switch valve 45 are connected to another side of the bidirectional piston pump 31 by a piping 47. Further, a piping 49 is connected to a middle of the piping 47, and this piping 49 is connected to the oil tank 27 via a check valve 51 and a suction filter 53.

Further, a throttle valve 55 and a high pressure preference type shuttle valve 57 are provided between the piping 41 and the piping 29. A piping 59 is connected to a discharge side of the high pressure preference type shuttle valve 57. A relief valve 61 is provided in the piping 59, and a piping 63 is connected to the oil tank 27.

Figure 7:
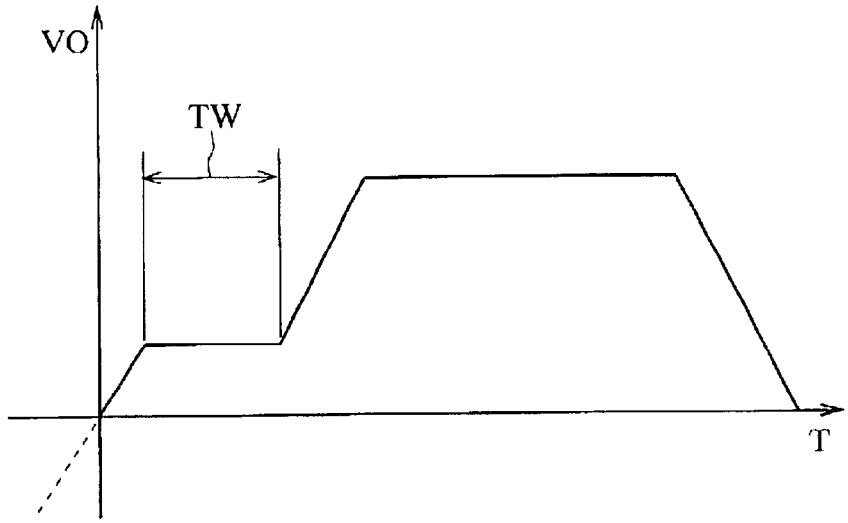
FIG. 7 is a graph showing a ram moving speed pattern.

The control apparatus 18 that controls the AC servo motor 39 has a ram moving speed pattern command portion 65 that provides a moving speed pattern of the upper table 5U that corresponds to the ram. In this ram moving speed pattern command portion 65, a command is given so as to reverse a vertical movement of the upper table 5U, as in a moving speed pattern shown in FIG. 7 in which a vertical axis is indicated by an instructed moving speed VO of the ram and a horizontal axis is indicated by a time T. Thereafter, commands are given to stop an increase of the moving speed, move at a fixed speed only for a predetermined warmup time TW and thereafter increase the moving speed again. Further, a command position counter 67 reads the position of the upper table 5U on the basis of the moving speed pattern given from the ram moving speed pattern command portion 65.

A position counter 71 feeds back a position signal 69 given from the linear scale 11 that detects the position of the upper table 5U. An adder 73 adds the feed-back position signal and a command position read by the command position counter 67 mentioned above. A ram motion gain determining portion 75 determines a gain on the basis of a signal added by the adder 73, and a command is generated to the AC serve motor 39 after being amplified by an amplifier 77.

According to the structure mentioned above, in the case that the working fluid is charged into the upper cylinder chamber 19U and the lower cylinder chamber 19L, the bidirectional piston pump 31 stops and the piston 19R rapidly moves the upper table 5U downward from a state of being at a top dead center due to its own weight and the hydraulic cylinder 13R. The piping 41 and the piping 47 are connected by switching the sequence switch valve 45, and the bidirectional piston pump 31 is rotated by the AC-servo motor 39.

Figure 6:
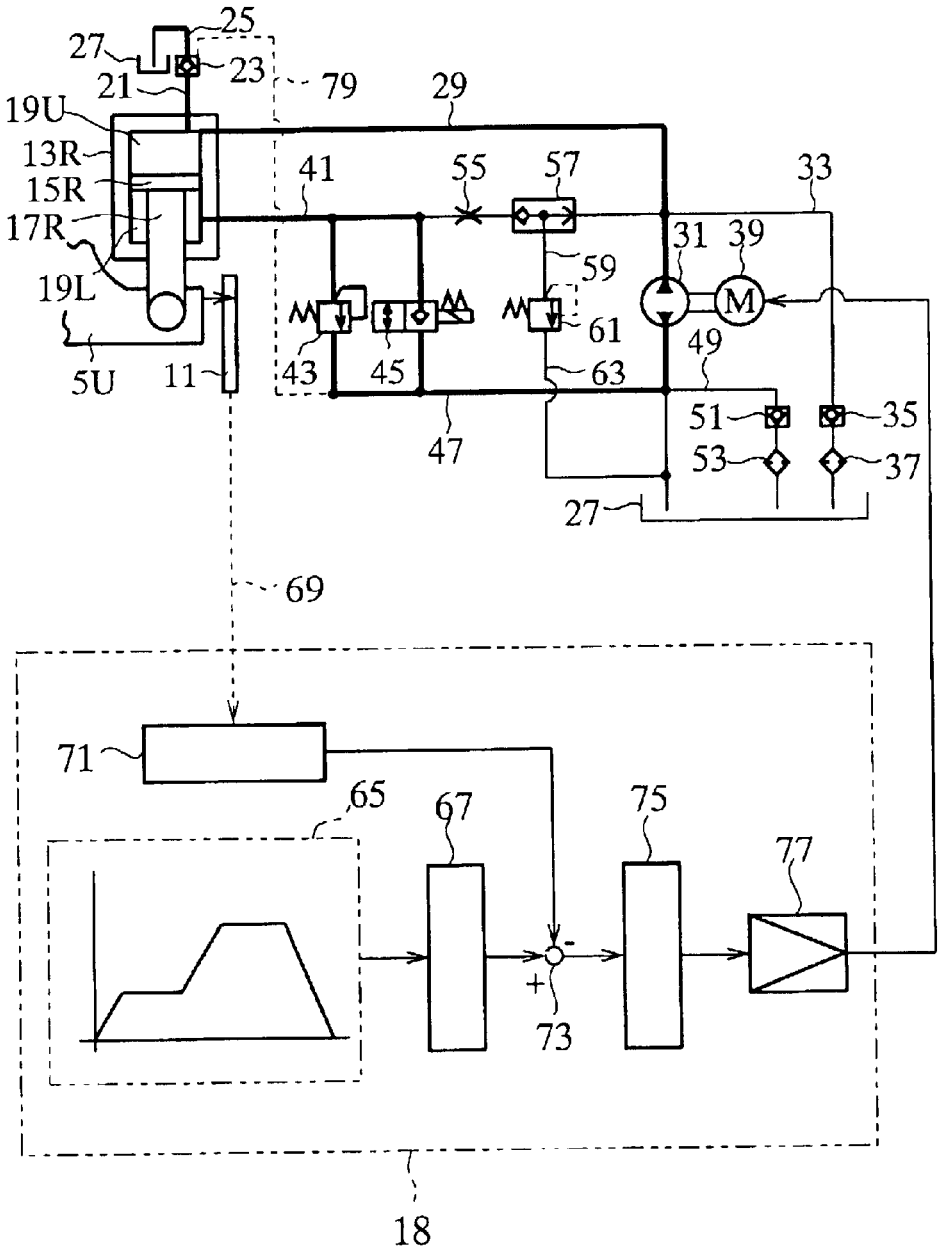
FIG. 6 is a circuit and block diagram showing a structure of a hydraulic circuit and a control apparatus in the press brake according to the present invention.

In the case of moving further downward to execute the bending process, the sequence switch valve is set to a state shown in FIG. 6. The working fluid from the lower cylinder chamber 19L is returned to bidirectional piston pump 31 through the piping 41, the counter balance valve 43 and the piping 47, and is supplied from the piping 29 to the upper cylinder chamber 19U in the hydraulic cylinder 13R. Accordingly, the piston 19R moves downward and the upper table 5U moves downward, thereby executing the bending process.

Incidentally, since a cross sectional area in a lower surface side of the piston 19R is smaller than an upper surface side, an amount of the working fluid returning to the bidirectional piston pump 31 from the lower cylinder chamber 19L is less than an amount of the working fluid charged into the upper cylinder chamber 19U, so that the working fluid is refilled from the oil tank 27 via the check valve 51.

In the case that the working fluids in the upper and lower cylinder chambers 19U and 19L become high pressure, the structure is made such that a part of the working fluid is returned to the oil tank 27 from the relief valve 61 via the high pressure preference type shuttle valve 57 through a piping 63.

In the case of reversing the hydraulic cylinder 13R on the basis of the pattern signal given from the ram moving speed pattern command portion 65, so as to move the upper table 5U upward, the AC servo motor 39 is reverse rotated in an opposite direction (to that of the case mentioned above) on the basis of the reverse rotation command, so as to reverse rotate the bidirectional piston pump 31. The working fluid from the upper cylinder chamber 19U, in a state in which the piston 19R moves downward, is supplied to the lower cylinder chamber 19L through the piping 29, the bidirectional piston pump 31, the piping 47, the switch valve 45, the piping 41 and the like. Accordingly, the piston 19R moves upward and the upper table 5U starts moving upward.

Further, when the command position counter 67 reads the ram moving speed pattern given from the ram moving speed pattern command portion 65, and the piston 19R reaches a predetermined upward moving speed, a command is given so that acceleration is stopped so as to move upward at a fixed speed for a predetermined warmup time TW. The check valve 51 is securely closed during this period. Thereafter, when the warmup time TW has passed, the check valve 51 is closed and there is generated a state in which a back flow of the working fluid does not occur, an acceleration is executed until an upward moving speed of the upper table 5U reaches a predetermined speed. Acceleration is executed by controlling the AC servo motor 39.

Incidentally, when a pressure of the working fluid charged into the lower cylinder chamber 19L becomes higher than a predetermined value, the prefill valve 23 is opened according to a pilot signal 79, and the working fluid is fed to the oil tank 27 from the upper cylinder chamber 19U through the prefill valve 23.

Figure 1:
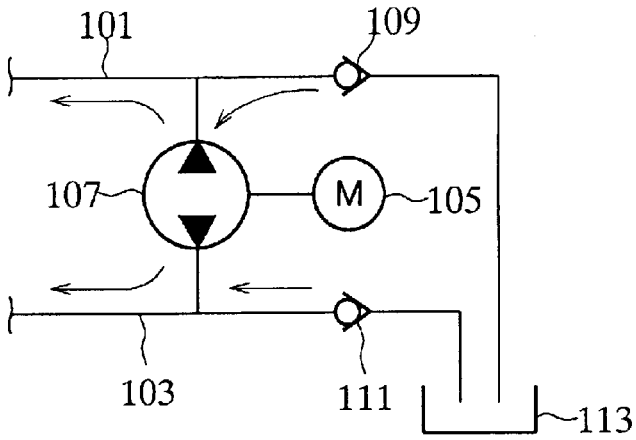
FIG. 1 is a schematic view showing a main portion of a hydraulic circuit of a press brake according to a conventional art.
Figure 2:
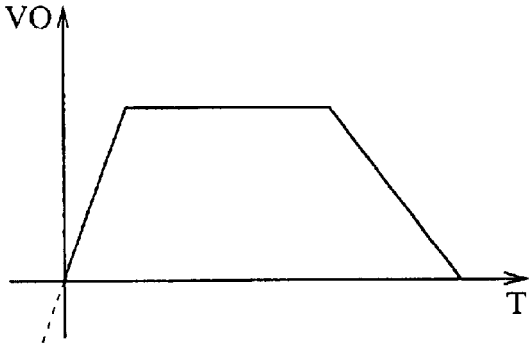
FIG. 2 is a graph showing a ram moving speed pattern according to the conventional art.
Figure 3:
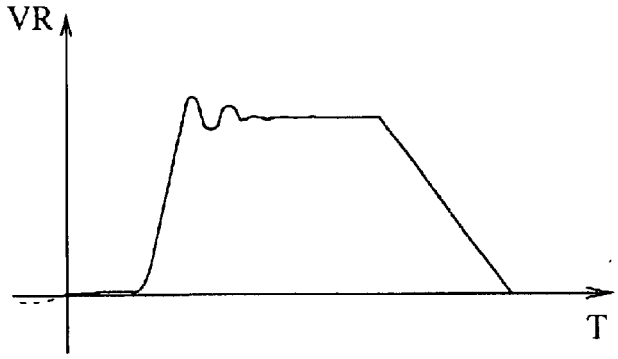
FIG. 3 is a graph showing an actual moving speed of a ram when movement is directed on the basis of the ram moving speed pattern shown in FIG. 2.
Figure 8:
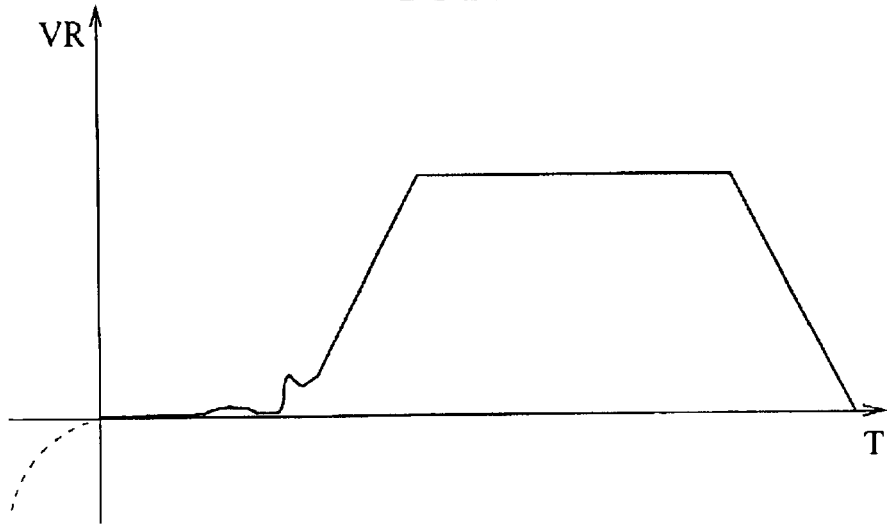
FIG. 8 is a graph showing an actual moving speed of a ram when movement is instructed on the basis of the ram moving speed pattern shown in FIG. 7.

As a result of the above, the structure is made such that the warmup time TW is provided to temporarily keep the moving speed fixed in the course of the low moving speed of the upper table 5U, after reverse rotating the bidirectional piston pump 31. The check valves 35 and 51 are closed before the great positive pressure is applied. Accordingly, as shown in FIG. 8, in which a vertical axis is indicated by an actual speed VR of the ram and a horizontal axis is indicated by a time T, it is possible to reduce the shock at the rising time due to the surge pressure which is conventionally a problem (refer to FIG. 3), and it is possible to prevent the upper table 5U from being vibrated at a time of moving. Therefore, it is possible to increase a motion gain of the upper table 5U so as to improve a productivity.

Of course, the present invention can be carried out according to the other aspects by executing a suitable modification without being limited to the embodiment mentioned above. That is, in the embodiment mentioned above, the press brake 1 moves the upper table 5U upward and downward as has been explained; however, the benefits of the present invention can be obtained when a press brake moves the lower table 5L upward and downward.

Further, the warmup for keeping the ram speed fixed may be executed for a fixed ram moving distance.

A second embodiment will be explained below with reference to the drawings.

Since the bidirectional fluid pump described in the first embodiment is used under a high rotation and a high pressure, there is an advantage that it is possible to make a capacity of the servo motor driving the bidirectional fluid pump small.

However, the bidirectional fluid pump mentioned above generates a noise when being used at a high rotation. Further, when being used at a high rotation and a high pressure, it has a nature of generating further great noise.

Figure 9:
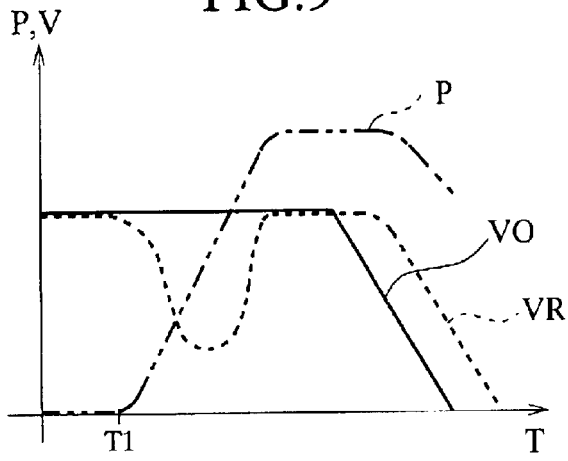
FIG. 9 is a graph showing an actual speed and a pressure of the ram with respect to a ram speed command value in a bending process.
Figure 10:
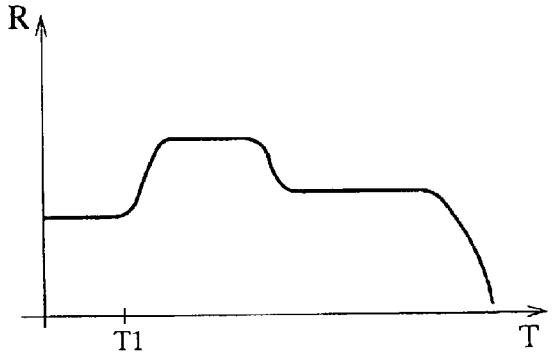
FIG. 10 is a graph showing a rotational amount of a servo motor in the bending process shown in FIG. 9.
Figure 11:
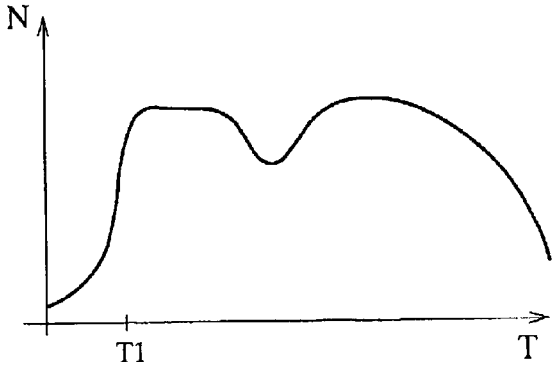
FIG. 11 is a graph showing a magnitude of noise with respect to the rotational amount of the servo motor shown in FIG. 10.

Accordingly, as shown in FIG. 9, in the case of vertically moving the ram according to the ram moving pattern (a solid line in FIG. 9), so as to execute the bending process, an actual ram moving speed VR (shown by a broken line in FIG. 9) is reduced so as to be deviated from the ram speed command value VO at a time T1 when the punch is brought into contact with a work or during the bending process. Accordingly, in order to remove the deviation and move the actual speed close to the command speed, an amount of rotation R of the servo motor is increased so as to make the rotation of the bidirectional fluid pump high as shown in FIG. 10. Accompanying this, as shown in FIG. 11, there is a problem in that the noise becomes great.

Further, as shown by a two-dot chain line in FIG. 9, since the bidirectional fluid pump is used under the high pressure P at a time T1 when the punch is brought into contact with the work and during the later bending process, there is a problem that a further great noise is generated.

The press brake according to the second embodiment corresponds to an improvement of the press brake according to the first embodiment.

Since a main body portion of the press brake according to the second embodiment of this invention is the same as the main body portion of the press brake 1 according to the first embodiment, explanation thereof will be omitted.

Figure 12:
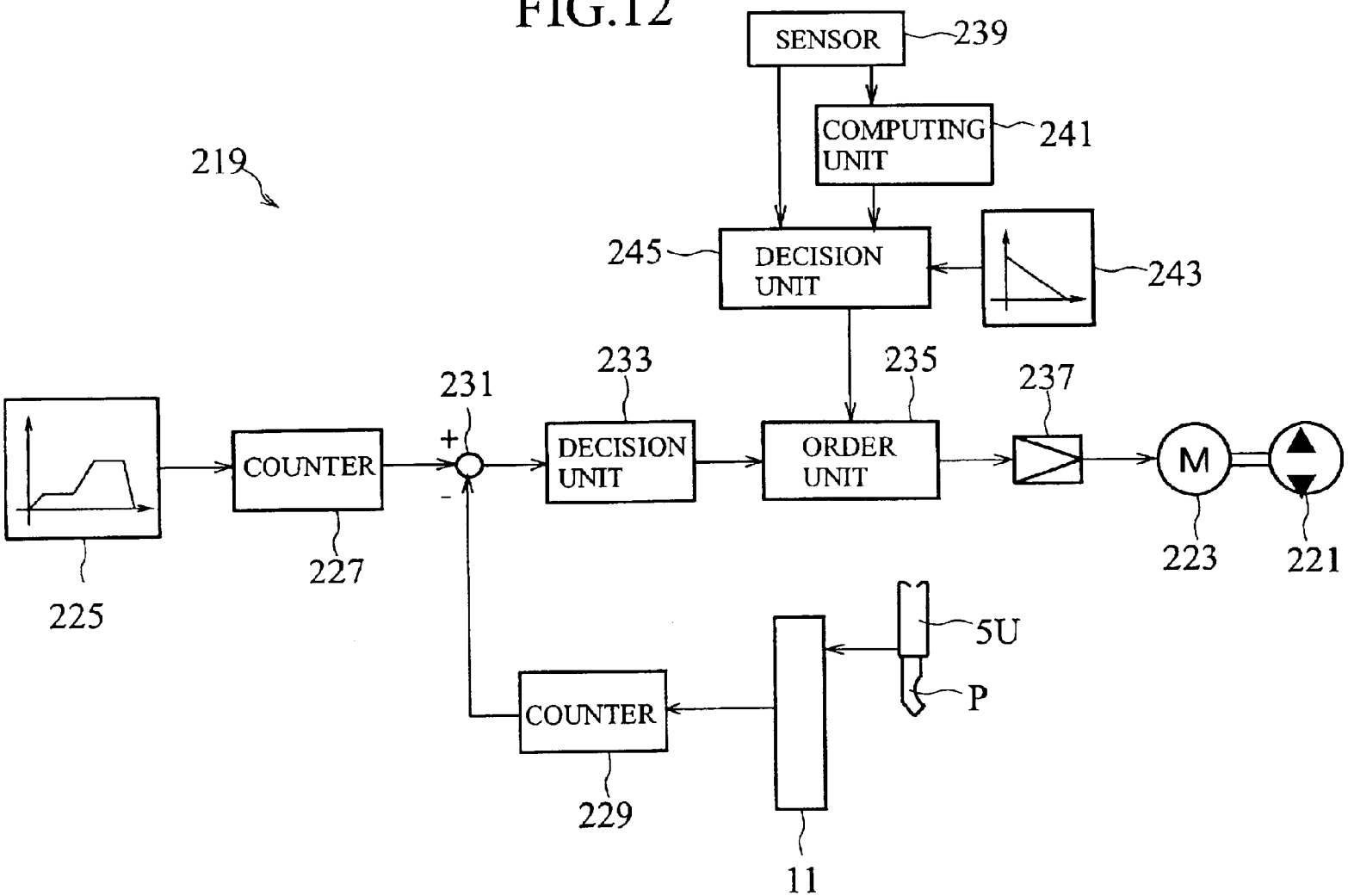
FIG. 12 is a block diagram showing a structure of a control apparatus that executes a method of controlling a bidirectional fluid pump of a hydraulic cylinder according to the present invention.

A control apparatus 219 with respect to the hydraulic cylinders 13L and 13R will be explained with reference to FIG. 12. Incidentally, since the same control is applied to the left and right hydraulic cylinders 13L and 13R, a control of an AC servo motor 223 that corresponds to a servo motor that rotates a bidirectional piston pump 221 (corresponding to a bidirectional fluid pump for the right hydraulic cylinder 13R) will be explained as follows.

That is, in this control apparatus 219, there is provided a ram moving speed pattern command portion 225 that instructs a moving speed pattern for moving, for example, the upper table 5U corresponding to the ram. In this ram moving speed pattern command portion 225, an upward and downward movement of the upper table 5U is set according to a moving speed pattern shown in FIG. 12. Further, a command position counter 227 reads a command position of the upper table 5U on the basis of a command pattern given from the ram moving speed pattern command portion 225.

A position counter 229 reads an actual position signal given from the linear scale 11 (the ram position detecting means) that detects the position of the upper table 5U. The actual position signal is read so as to be fed back. An adder 231 adds the feed-back signal and the command position read by the command position counter 227 mentioned above so as to compare. A ram motion gain determining portion 233 determines a ram motion gain on the basis of a signal added by the adder 231. A servo motor rotational amount command portion 235 is connected to the ram motion gain determining portion 233. A signal given from the servo motor rotational amount command portion 235 is amplified by an amplifier 237 and a command is output to the AC servo motor 223.

Incidentally, a pressure sensor 239 provided in the bidirectional piston pump 221, a computing portion 241 computing a change amount of pressure on the basis of a pressure given from the pressure sensor 239, and a memory 243 storing a relation between a pressure and a ram moving speed and a relation between a change amount of pressure and a ram moving speed, are connected to a ram speed cramp value determining portion 295 that determines a moving speed of the upper table 5U corresponding to the ram. This ram speed cramp value determining portion 245 is connected to a servo motor rotational amount command portion 235 that instructs a rotational amount of the AC servo motor 223 that corresponds to the ram moving speed determined by the ram motion gain determining portion 233.

Figure 13:
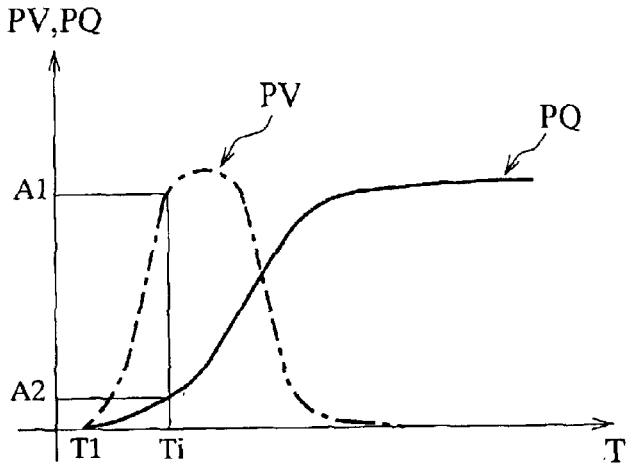
FIG. 13 is a graph showing an absolute amount of pressure and a change amount of pressure during the bending process.

In FIG. 13, there is shown an absolute amount PQ (shown by a solid line in FIG. 13) of the pressure of the bidirectional piston pump 221 and a change amount PV (shown by a single-dot chain line in FIG. 13) of the pressure in the case of executing the bending process. The absolute amount PQ of the pressure starts increasing at a time T1, when the punch P is brought into contact with the work, and the absolute amount PQ of the pressure gradually increases during the bending process.

Accordingly, a first derivative corresponding to the change amount PV of the pressure rapidly rises from the time T1 when the punch P is brought into contact with the work, and becomes substantially fixed during the period when the bending process is executed at a fixed pressure. Further, when the absolute amount PQ of the pressure becomes fixed, the change amount PV of the pressure becomes zero.

Figure 14:
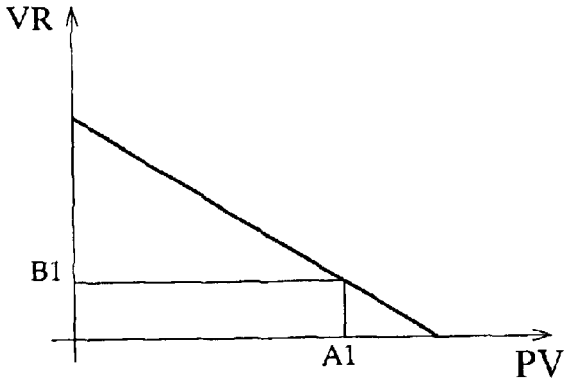
FIG. 14 is a graph showing a relation between a ram speed and a pressure change amount which should be employed when taking the noise of the bidirectional fluid pump into consideration.

Further, in FIG. 14, there is shown a ram moving speed VR which is previously stored in the memory 243, taking the noise of the bidirectional piston pump 221 into consideration, and which should be set with respect to the change amount PV of the pressure. Further, in FIG. 15, there is shown a ram moving speed VR which is previously stored in the memory 243, taking the noise of the bidirectional piston pump 221 into consideration, and which should be set with respect to the absolute amount PQ of the pressure.

As mentioned above, since the noise is increased at a time when the bidirectional piston pump 221 is under the high rotation and the high pressure, a value A1 of the change amount PV of the pressure and a value A2 of the absolute amount PQ of the pressure in a time T1 are calculated in the graph shown in FIG. 13. Ram moving speeds B1 and B2, which are ram moving speeds to be set with respect to the pressure and the change amount of pressure, are respectively calculated on the basis of FIGS. 14 and 15. As a result of comparing the ram moving speeds B1 and B2, and setting the lower speed as the ram speed clamp value, in the case that the speed computed by the ram motion gain determining portion 233 is larger than the ram speed clamp value, the ram speed clamp value is instructed to the AC servo motor 223.

Figure 15:
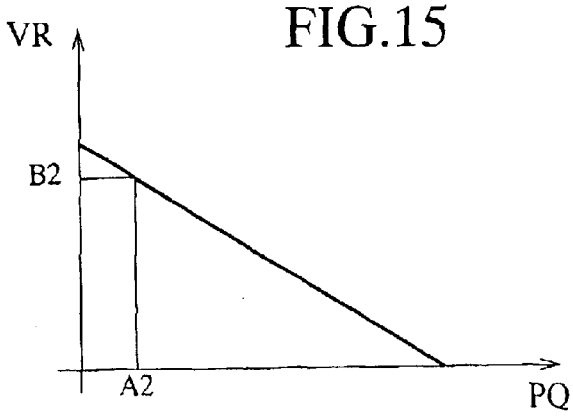
FIG. 15 is a graph showing a relation between a ram speed and an absolute amount of pressure which should be employed when taking the noise of the bidirectional fluid pump into consideration.

Accordingly, in the embodiment shown in FIGS. 13, 14 and 15, the structure is made such that the ram moving speed B1 is employed, and the rotational amount, corresponding to the smaller value between the ram moving speed B1 and the value computed by the ram motion gain determining portion 233, is provided to the AC servo motor 223 as an instruction.

According to the structure mentioned above, the command position counter 227 reads the command position of the upper table 5U according to the pattern given from the ram moving speed pattern command portion 225. This position and the actual position, read by the position counter 229 on the basis of the position signal of the linear scale 11, are compared by the adder 231, and the ram motion gain determining portion 233 determines the gain. Here, the servo motor rotational amount command portion 235 compares the rotational amount corresponding to the ram speed determined by the ram speed clamp value determining portion 245 with the rotational amount computed by the ram motion gain determining portion 233, determines the smaller rotational amount and provides the smaller rotational amount to the AC servo motor 223 as an instruction, and rotates the bidirectional piston pump 221.

According to the results mentioned above, since it is possible to restrict the rotational amount, at a time of high speed rotation and high pressure rotation of the bidirectional piston pump 221, to a minimum rotational amount, it is possible to restrict the generation of noise to be equal to or less than a fixed level.

Incidentally, in the same manner as the first embodiment, this invention can be carried out according to other aspects by executing a suitable modification without being limited by the above-described embodiment of the invention. That is, in the embodiment of the invention mentioned above, the press brake 1 moves the upper table 5U upward and downward as the ram so as to execute the bending process; however, the same aspects can be applied to moving the lower table 5L upward and downward so as to execute the bending process.

What is claimed is:

1. A press brake, comprising:

a hydraulic cylinder that vertically moves a movable ram;

a bidirectional fluid pump that is bidirectionally rotated by a servo motor and that operates the hydraulic cylinder to vertically move the ram; and a controller that controls the servo motor, the controller comprising:

a ram moving speed pattern setter that sets a ram moving speed pattern to maintain a ram speed for one of a predetermined time and a predetermined distance after a rotation of the bidirectional fluid pump reversed, and that thereafter changes the ram speed to a predetermined speed;

a counter that reads a ram position based on the ram speed instructed by the ram moving speed pattern setter;

a position detector that detects the actual ram position; and an adder that compares the position read by the counter and the actual position detected by the position detector to conform the operation of the servo motor to the ram moving speed pattern.

2. A method for controlling a bidirectional fluid pump of a press brake, the method comprising:

reversing the bidirectional fluid pump to reverse a vertical movement of a ram that is moved by a hydraulic cylinder;

setting one of a predetermined time and a predetermined distance to maintain a ram speed after the bidirectional fluid pump is reversed; and controlling the bidirectional fluid pump to change the ram speed to a predetermined speed after the ram is moved for one of the predetermined time and the predetermined distance.

3. A method for controlling a bidirectional fluid pump of a press brake, the method comprising:

measuring a hydraulic force in a bidirectional fluid pump and computing a change in the hydraulic force;

calculating a ram speed based on at least one of a predetermined relationship between the speed and a detected pressure and between the speed and a detected change in the pressure; and instructing a servo motor to rotate the bidirectional fluid pump, by an amount corresponding to the calculated speed, to vertically move the ram at the calculated speed.

4. A method for controlling a bidirectional fluid pump of a press brake, the method comprising:

measuring a hydraulic force in a bidirectional fluid pump and computing a change in the hydraulic force;

calculating a ram speed based on a predetermined relationship between the speed and a detected pressure, and calculating a ram speed based on a predetermined relationship between the speed and a detected change in the pressure;

obtaining the lower of the calculated speeds; and instructing the servo motor to rotate the bidirectional fluid pump, by an amount corresponding to the lower of the calculated speeds, to vertically move the ram at the lower speed.

5. A press brake, comprising:

a hydraulic cylinder that vertically moves a movable ram;

a bidirectional fluid pump that is rotated bidirectionally by a servo motor and that operates the hydraulic cylinder to vertically move the ram;

a moving speed pattern setter that sets a ram moving speed pattern;

a pressure sensor that determines one of a pressure and a pressure change;

a speed calculator that calculates a ram speed, based on one of the pressure and the pressure change; and a rotation amount instructor that instructs a servo motor to rotate the bidirectional fluid pump, by an amount corresponding to the calculated speed, to move the ram at the calculated speed.

6. A press brake, comprising:

a hydraulic cylinder that vertically moves a movable ram;

a bidirectional fluid pump that is rotated bidirectionally by a servo motor and that operates the hydraulic cylinder to move the ram;

a position detector that detects a position of the ram;

a moving speed pattern setter that sets a moving pattern of the ram;

an adder that compares a set ram position from the moving speed pattern setter with the detected ram position to conform the operation of the servo motor to the ram moving speed pattern;

a pressure computer that computes a pressure change of the bidirectional fluid pump, based on a pressure detected by a pressure sensor;

a memory that stores relationships between the speed and the detected pressure and between the speed and the pressure change; and a servo motor rotation setter that determines the lower of a speed calculated based on a relationship between the speed and the detected pressure and a speed calculated based on a relationship between the speed and the pressure change, and that instructs the servo motor to rotate the bidirectional fluid pump, by an amount corresponding to the determined speed, to move the ram at the lower speed.

* * * * *

UNITED STATES PATENT AND TRADEMARK OFFICE

CERTIFICATE OF CORRECTION

PATENT NO. : 6,874,343 B1
DATED : April 5, 2005
INVENTOR(S) : N. Ariji

It is certified that error appears in the above-identified patent and that said Letters Patent is hereby corrected as shown below:

Title page,
Item [57], ABSTRACT,
Line 12, after "detected" insert -- pressure change detected --.

Column 11,
Line 3, after "pump" insert -- is --.

Signed and Sealed this

Twenty-seventh Day of December, 2005

JON W. DUDAS
*Director of the United States Patent and Trademark Office*